US009523486B2

(12) United States Patent
Boyink

(10) Patent No.: US 9,523,486 B2
(45) Date of Patent: Dec. 20, 2016

(54) LIGHTING SYSTEM AND DECORATIVE ARTICLE INCLUDING SAME

(71) Applicant: GEEK MY TREE LLC, Grand Haven, MI (US)

(72) Inventor: Bradley R. Boyink, Spring Lake, MI (US)

(73) Assignee: GEEK MY TREE INC., Grand Haven, MI (US)

( * ) Notice: Subject to any disclaimer, the term of this patent is extended or adjusted under 35 U.S.C. 154(b) by 4 days.

(21) Appl. No.: 14/574,883

(22) Filed: Dec. 18, 2014

(65) Prior Publication Data

US 2016/0178172 A1 Jun. 23, 2016

(51) Int. Cl.

| | |
|---|---|
| ***F21V 23/00*** | (2015.01) |
| ***F21S 4/00*** | (2016.01) |
| ***H05B 33/08*** | (2006.01) |
| *F21W 121/04* | (2006.01) |
| *F21V 23/04* | (2006.01) |
| *F21S 10/02* | (2006.01) |
| *F21Y 101/00* | (2016.01) |

(52) U.S. Cl.

CPC ..... *F21V 23/003* (2013.01); *F21S 4/002* (2013.01); *F21S 4/15* (2016.01); *H05B 33/0842* (2013.01); *F21S 10/023* (2013.01); *F21V 23/045* (2013.01); *F21W 2121/04* (2013.01); *F21Y 2101/00* (2013.01)

(58) Field of Classification Search

CPC ..... A47G 2033/0827; F21S 4/10; F21S 10/00; F21W 2121/04; F21V 23/003; F21V 23/06; F21V 23/02

See application file for complete search history.

(56) References Cited

U.S. PATENT DOCUMENTS

| | | | |
|---|---|---|---|
| 4,591,227 | A | 5/1986 | Colonna |
| 4,705,483 | A | 11/1987 | Davis et al. |
| 4,736,282 | A | 4/1988 | Ahroni |

(Continued)

FOREIGN PATENT DOCUMENTS

| | | | |
|---|---|---|---|
| CA | 1270292 | A1 | 6/1990 |
| DE | 202006008823 | U1 | 9/2006 |
| WO | WO2010007189 | A2 | 1/2010 |

OTHER PUBLICATIONS

Printed Instructions for iTwinkle Light Set, available from Nicolas Holiday Inc., obtained from http://itwinklelight.com/Products6.aspx on Jan. 9, 2015.

(Continued)

*Primary Examiner* — Peggy Neils

(74) *Attorney, Agent, or Firm* — Warner Norcross and Judd LLP

(57) ABSTRACT

A lighting system comprises a crown including a plurality of connectors for engaging a plurality of light strands. The lighting system further comprises a plurality of light strands extending between first and second ends. The first ends of the light strands are removably engageable with the connectors of the crown. Each of the light strands includes at least one lighting element. Finally, the lighting system also comprises a controller in electrical communication with the crown for selectively controlling the lighting elements of the light strands. The present invention additionally provides a decorative article including the lighting system.

4 Claims, 3 Drawing Sheets

(56) References Cited

U.S. PATENT DOCUMENTS

| | | | | |
|---|---|---|---|---|
| 4,870,547 | A | 9/1989 | Crucefix | |
| 5,057,976 | A | 10/1991 | DuMong | |
| 5,150,963 | A | 9/1992 | Hill | |
| 5,700,081 | A | 12/1997 | Mengle et al. | |
| 5,746,504 | A | 5/1998 | Dodson | |
| 6,224,231 | B1 | 5/2001 | Personius | |
| 6,285,140 | B1 | 9/2001 | Ruxton | |
| 6,386,728 | B1 | 5/2002 | Colonna | |
| 6,424,096 | B1 * | 7/2002 | Lowe | H05B 37/0272 315/185 R |
| 7,102,301 | B2 * | 9/2006 | Oskorep | F21S 4/10 315/178 |
| 8,240,883 | B2 | 8/2012 | Barbieri | |
| 8,262,243 | B1 | 9/2012 | Pasdar | |
| 8,299,719 | B1 | 10/2012 | Moshirnoroozi | |
| 8,378,781 | B1 | 2/2013 | Peterson | |
| 8,476,835 | B1 | 7/2013 | Parisi et al. | |
| 8,492,983 | B1 | 7/2013 | Berg et al. | |
| 8,678,615 | B1 | 3/2014 | Ko | |
| 8,779,687 | B2 | 7/2014 | Harbers | |
| 8,841,844 | B2 | 9/2014 | Neuman et al. | |
| 8,941,312 | B2 | 1/2015 | McRae | |
| 9,153,171 | B2 | 10/2015 | Sakariya et al. | |
| 2003/0057886 | A1 * | 3/2003 | Lys | F21V 21/002 315/291 |
| 2008/0030149 | A1 | 2/2008 | Callahan | |
| 2009/0085496 | A1 | 4/2009 | Osborn | |
| 2012/0086349 | A1 * | 4/2012 | Segan | H05B 33/0842 315/187 |
| 2013/0201658 | A1 * | 8/2013 | Bogart | F21S 4/001 362/95 |
| 2014/0049168 | A1 * | 2/2014 | Chen | F21S 4/001 315/161 |
| 2015/0070878 | A1 * | 3/2015 | Yu | F21S 4/001 362/123 |
| 2015/0077999 | A1 * | 3/2015 | Chen | F21V 23/001 362/249.08 |
| 2015/0084515 | A1 | 3/2015 | Altamura et al. | |
| 2015/0102731 | A1 * | 4/2015 | Altamura | H05B 33/0821 315/152 |
| 2015/0192285 | A1 * | 7/2015 | Chen | F21V 23/06 315/185 R |
| 2015/0366039 | A1 * | 12/2015 | Noori | H05B 37/0272 315/307 |
| 2016/0021724 | A1 * | 1/2016 | Kinderman | H05B 37/0281 315/192 |
| 2016/0047516 | A1 | 2/2016 | Taylor | |
| 2016/0066381 | A1 | 3/2016 | Despesse | |

OTHER PUBLICATIONS

English Abstract for DE202006008823 extracted from espacenet.com database on Jan. 9, 2015, 1 page.

English Abstract for WO2010007189 extracted from espacenet.com database on Jan. 9, 2015, 1 page.

Wikipedia, The Free Encyclopedia, "Holiday lighting technology," (accessed Oct. 13, 2016), https://en.wikipedia.org/wiki/Holiday_lighting_technology.

* cited by examiner

LIGHTING SYSTEM AND DECORATIVE ARTICLE INCLUDING SAME

FIELD OF THE INVENTION

The present invention generally relates to a lighting system and, more specifically, a lighting system for an ornamental tree and to a decorative article including the lighting system.

DESCRIPTION OF THE RELATED ART

Lighting systems are known in the art and are utilized in a variety of applications for diverse purposes, including aesthetics and decoration. One such example of lighting systems utilized for decorative purposes include holiday lighting systems, e.g. Christmas tree lights.

Conventional holiday lighting systems include a variety of individual lighting cords extending between opposite ends, with one end being a female connector and the other end being a male connector. The lighting cords may be engaged to one another or may be individually connected to an electrical outlet. The lighting cords are commonly wrapped around Christmas trees and are prone to knotting and interweaving, which makes installation and subsequent removal and separation of the lighting cords time consuming.

Conventional holiday lighting systems have been improved in a variety of ways, e.g. by converting from a serial to a parallel electrical configuration, and to include preprogrammed patterns and various colors for aesthetic purposes. However, even improvements to conventional holiday lighting systems leave limited customizable options to consumers.

SUMMARY OF THE INVENTION

The present invention provides a lighting system. The lighting system comprises a crown including a plurality of connectors for engaging a plurality of light strands. The lighting system further comprises a plurality of light strands extending between first and second ends. The first ends of the light strands are removably engageable with the connectors of the crown. Each of the light strands includes at least one lighting element. Finally, the lighting system also comprises a controller in electrical communication with the crown for selectively controlling the lighting elements of the light strands.

The present invention additionally provides a decorative article including the lighting system.

In one embodiment of the present invention, the controller is capable of being programmed with pattern data by a user. For example, the controller may be programmed with pattern data wirelessly, e.g. via an external device, and the pattern data may be stored for use at a later time by the user.

BRIEF DESCRIPTION OF THE DRAWINGS

Other advantages and aspects of this invention may be described in the following detailed description when considered in connection with the accompanying drawings wherein.

DETAILED DESCRIPTION OF THE INVENTION

The present invention provides a lighting system and a decorative article including the lighting system. The lighting system is particularly suited for use as holiday or other decorative lights, e.g. disposed on an ornamental tree, as described in detail below.

Figure 1:
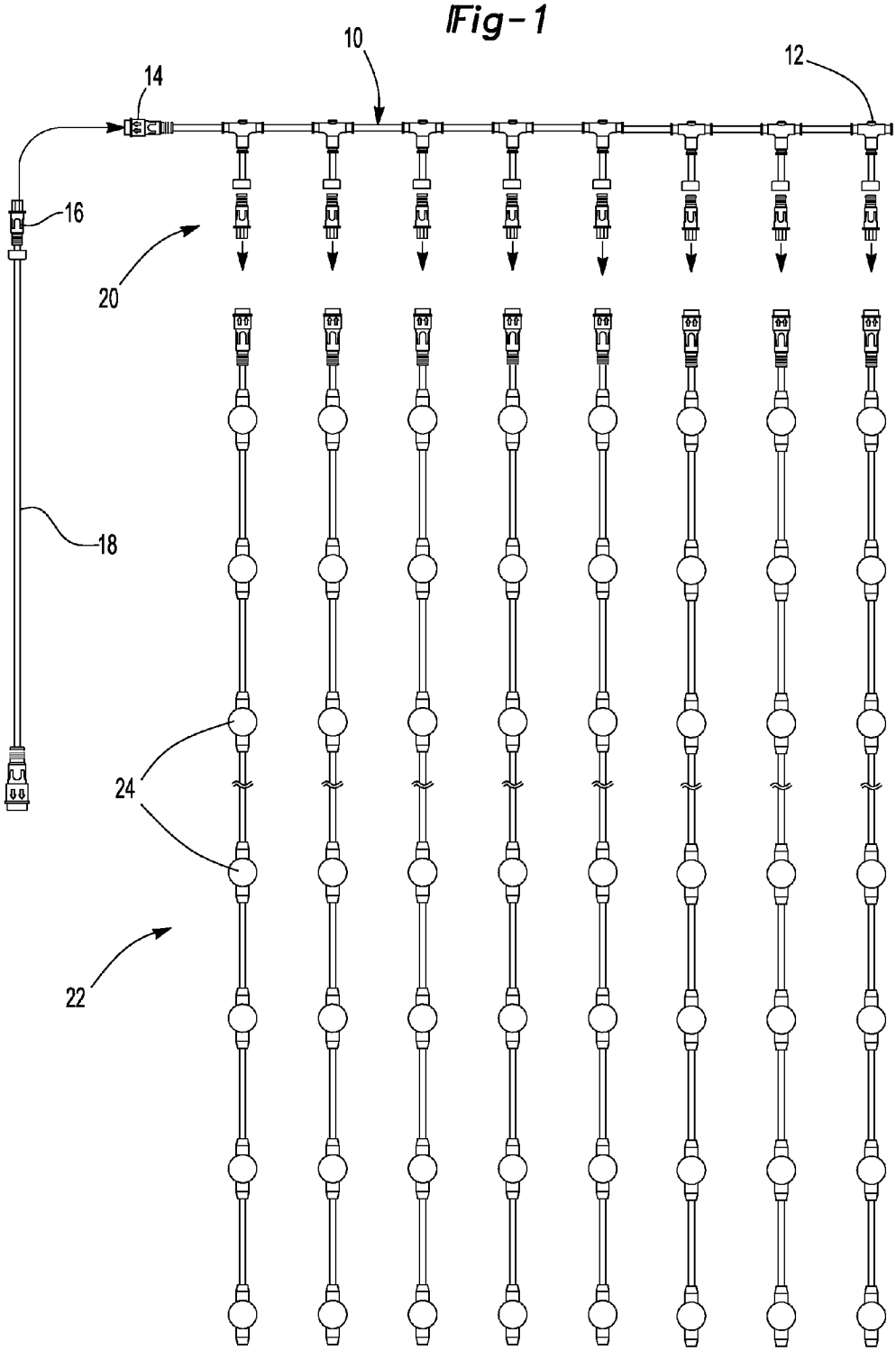
FIG. 1 illustrates an exploded view of one embodiment of a lighting system of the present invention.

Referring to FIG. 1, the lighting system includes a crown 10 extending between opposite plug ends 12, 14 and including a plurality of connectors 20 for engaging a plurality of light strands 22. The connectors 20 need not extend from the crown 10 as shown in FIG. 1. Instead, the connectors 20 may be flush with or recessed within the crown 10. The opposite plug ends 12, 14 of the crown 10 may engage one another such that the crown 10 is generally circular when the opposite plug ends 12, 14 are engaged. If desired, the crown 10 may have a shape other than circular, e.g. the crown 10 may be elliptical, hexagonal, octagonal, etc. in shape. Each of the light strands 22 extends between first and second ends, and the first end of each light strand 22 is removably engageable with one of connectors 20 of the crown 10. If desired, the second ends of the light strands 22 may terminate via a pass-through terminator. Each of the light strands 22 includes at least one lighting element 24, although the light strands 22 generally include a plurality of lighting elements 24, which are generally spaced from one another along a length of the light strands 22.

Because the lighting system is modular in design, the light strands 22 may be easily disengaged from the crown 10, and in certain embodiments the crown 10 may be advantageously straightened when the opposite plug ends 12, 14 are not engaged for ease of storage of the lighting system. Further, the modular design of the lighting system permits easy installation thereof, e.g. on an ornamental tree as holiday lighting. For example, the opposite plug ends 12, 14 of the crown 10 may be engaged (if the crown 10 includes the opposite plug ends 12, 14), and the crown 10 may be disposed about a top of the ornamental tree. The light strands 22 may be engaged with the connectors 20 of the crown 10 prior to disposing the crown 10 about the top of the ornamental tree, or the light strands 22 may be engaged with the connectors 20 of the crown 10 once the crown 10 is disposed about the top of the ornamental tree. Typically, the light strands 22 are engaged with the connectors 20 of the crown 10 at the time of disposing the crown 10 about the top of the ornamental tree, in which case the light strands 22 extend downwardly from the top of the ornamental tree, i.e., from the crown 10. The light strands 22 may optionally be wrapped or otherwise interweaved with branches or portions of the ornamental tree, or the light strands 22 may remain separate from the ornamental tree. Typically, each light strand 22 hands vertically from the crown 10 without engaging any features of the ornamental tree.

The crown 10 of the lighting system generally includes a power cord 18 having an end 16 that is engageable with the crown 10. For example, one of the opposite plug ends 12, 14 of the crown 10 may be a dual plug end (not shown) such that the dual plug end may engage the other plug end of the crown 10 and the end 16 of the power cord 18. Alternatively, the power cord 18 may be integral with the crown 10 such that the power cord 18 extends from the crown 10, e.g. the power cord 18 may be soldered directly to the crown 10 or a portion thereof. For example, the power cord 18 and the crown 10 may be a unitary piece, in which case the crown 10 need not include opposite plug ends 12, 14. At least a portion of the crown 10 is generally electrically conductive for transferring electrical current and data to the plurality of connectors 20 of the crown 10, although an exterior of the crown 10 is generally an insulator, e.g. plastic. In certain embodiments, the crown 10 comprises a cable, e.g. an electrical cable. The cable of the crown 10 may be modified for aesthetic purposes, e.g. to provide an aesthetic advantage when disposed on the ornamental tree, or to camouflage the crown 10 relative to the ornamental tree.

Figure 2:
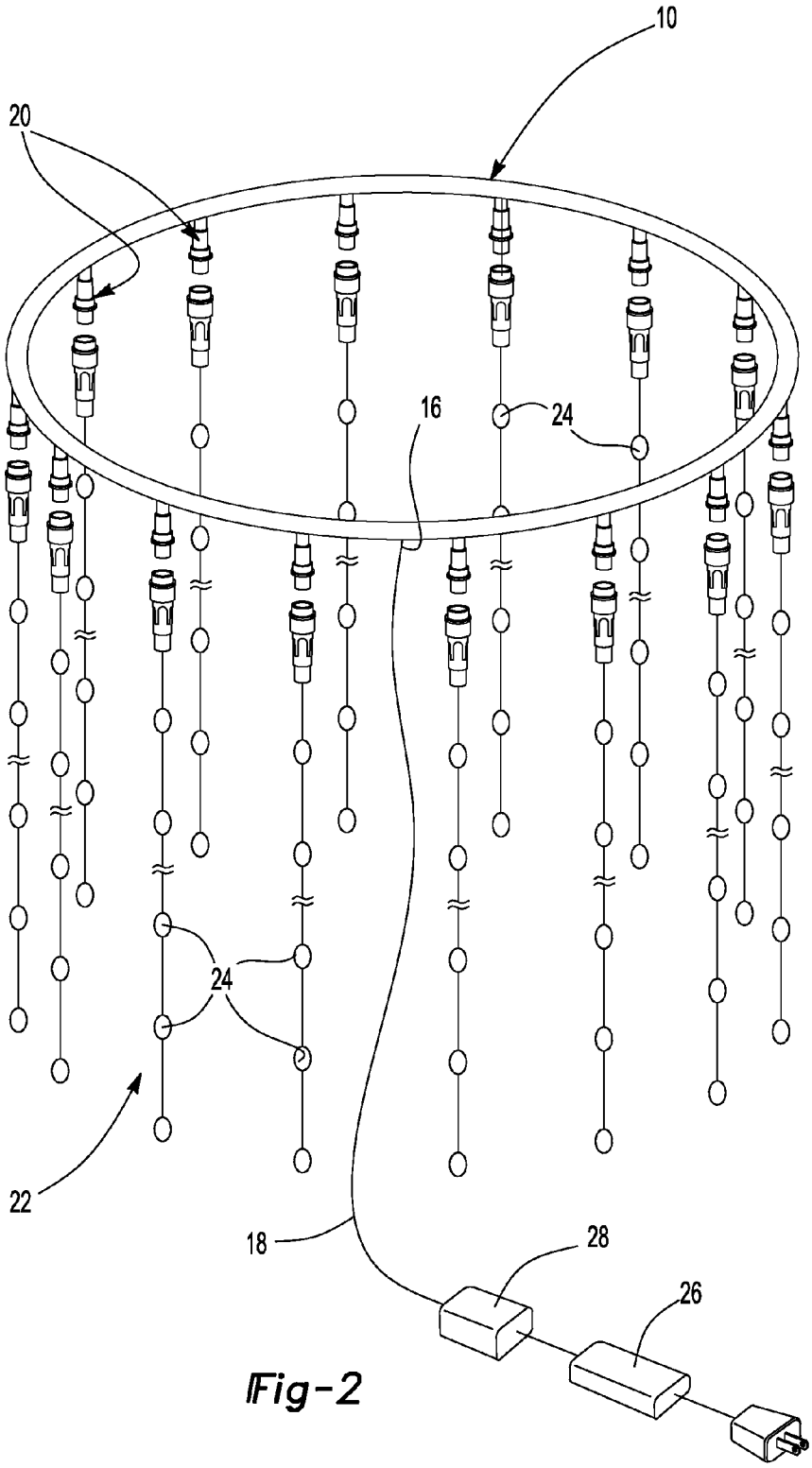
FIG. 2 illustrates a perspective view of another embodiment of the lighting system of the present invention.

FIG. 2 illustrates the crown 10 of the lighting system in a circular configuration, e.g. when the opposite plug ends (not shown) are engaged with one another. Alternatively, FIG. 2 illustrates the crown 10 when the crown 10 does not include the opposite plug ends. The light strands 22 are typically spaced from one another at a common distance, although the light strands 22 may be randomized about the crown 10. As shown in FIG. 2, the lighting system includes a controller 28 in electrical communication with the crown 10 for selectively controlling the lighting elements 24 of the light strands 22. In various embodiments, the lighting system includes a transformer 26 in electrical communication with the controller 28, which generally converts alternating current to direct current. Typically, the lighting system relies on direct current, and thus the transformer 26 enables the lighting system to be powered by a conventional electrical outlet, which supplies alternating current. Alternatively, the lighting system may operate via a direct power source, e.g. a battery, in which case the transformer 26 is not needed. Typically, the transformer 26 is utilized in the lighting system and is part of a power supply, which is in electrical communication with the controller 28 and supplies direct current to the controller 28 during use of the lighting system.

In various embodiments, the components of the lighting system may be referred to in alternate terms. For example, the crown may be referred to as a first electrical cord having first and second ends, a primary electrical connector at one of the ends, and a plurality of secondary electrical connectors between the first and second ends. The primary electrical connector is for connecting the first electrical cord with the controller, which may have a controller connector. In these embodiments, the light strands may be referred to as a plurality of second electrical cords each having first and second ends, an electrical connector at the first end, and a plurality of individually controllable lights between the first and second ends. More specifically, in these embodiments, each of the electrical connectors is adapted to be operatively connected to one of the secondary electrical connectors on the first cord, whereby the lights can be individually controlled by the controller when (a) the electrical connectors on the second cords are operatively connected to the secondary connectors on the first cord and (b) the primary connector on the first cord is operatively connected to the controller connector.

Figure 3:
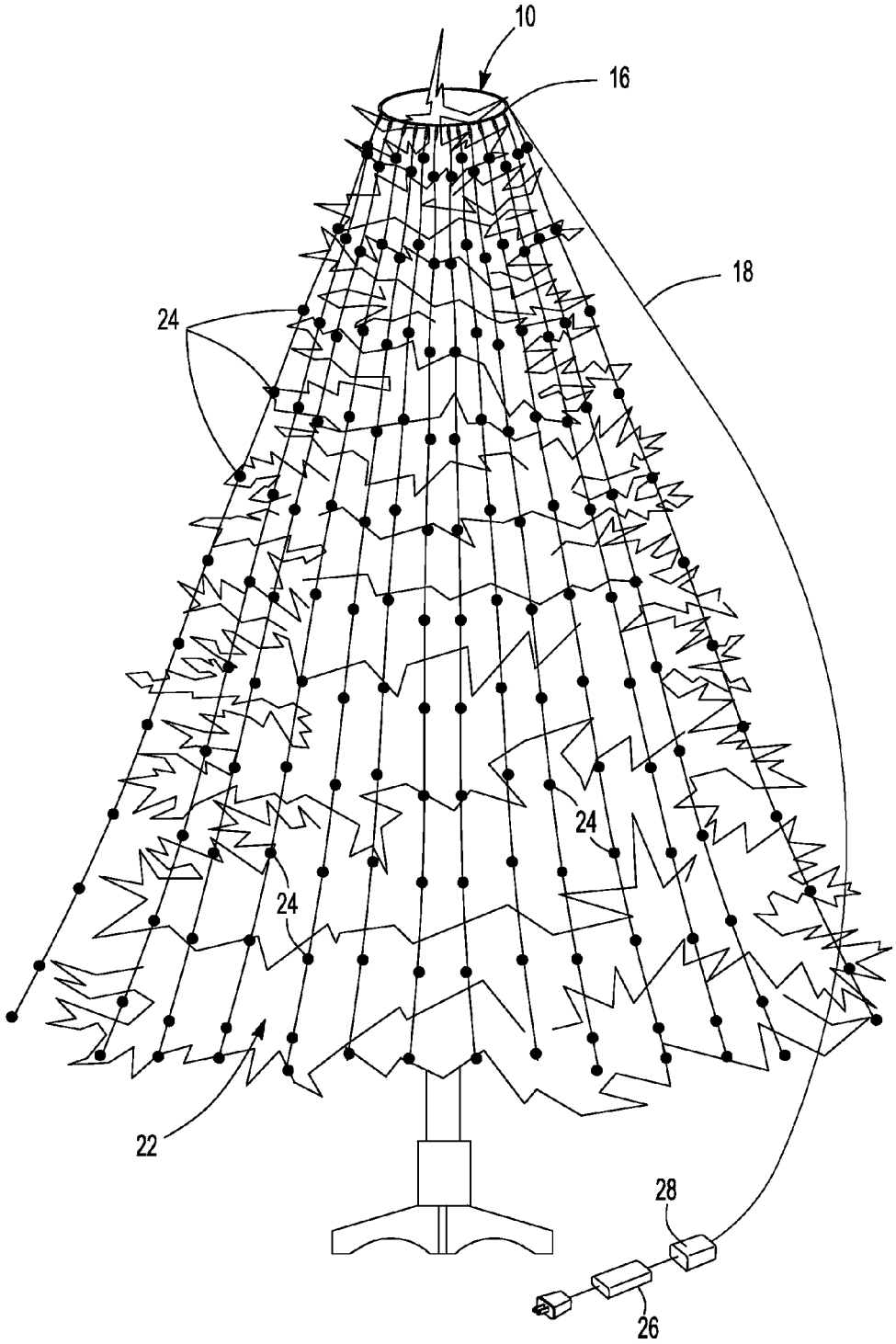
FIG. 3 illustrates a perspective view of one embodiment of the lighting system disposed upon an ornamental tree.

FIG. 3 illustrates the lighting system disposed upon the ornamental tree. As shown in FIG. 3, the crown 10 is disposed about the top of the ornamental tree. The crown 10 may have an adjustable diameter or cross-sectional size such that the crown 10 may be modified based on a size of the ornamental tree and the desired location of the lighting system relative to the ornamental tree. For example, the crown 10 may be flexible or otherwise adjustable. In these embodiments, the crown 10 may have a lesser diameter or cross-sectional size for smaller ornamental trees or when it is desirable for the crown 10 to be supported at the top of the ornamental tree. Alternatively, the crown 10 may be rigid and of dimensions suitable for a variety of ornamental tree sizes, as top-hanging of the crown 10 allows for use on a variety of tree sizes. As best shown in FIG. 3, the lighting system may be easily disposed or mounted upon the top of the ornamental tree without tangling or interweaving of the light strands 22. In fact, the light strands 22 may be left dangling vertically from the crown 10 while presenting a desirable aesthetic appeal.

The controller typically comprises a digital control device configured to individually control each of the lighting elements of the light strands for selectively controlling the lighting elements. By "selectively controlling" the lighting elements, it is meant that controller is configured to individually control at least one of luminosity and color of the lighting elements of the light strands. For example, luminosity is colloquially referred to as brightness, and thus the controller is typically capable of controlling whether each individual lighting element is on or off, the relative brightness thereof, and the color associated therewith, among other aspects of the lighting elements, as described below.

Typically, each lighting element comprises a light-emitting diode (LED) assembly. In certain embodiments, each LED assembly comprises a spherical ball or globe including more than one (e.g. two or three) LEDs, which may correspond to red, green, and blue. The LEDs of the LED assemblies are typically encapsulated by a translucent or transparent material, which may be glass or a polymeric material. The LED assemblies are typically each capable of producing 16.7 million colors. The LED assemblies are aesthetically pleasing from any vantage point or angle in view of their spherical ball or globe configuration.

In specific embodiments, each lighting element consumes 0.65 watts of power. In these or other embodiments, the controller is capable of selectively controlling two individual crowns and associated light strands. The two individual crowns may be operated separately from one another or may be operated together as one distinct unit and lighting system. In specific embodiments, each crown powers 80 individual lighting elements, which are typically dispersed amongst different light strands. For example, in one embodiment, the crown includes 8 light strands, with each of the light strands including 10 lighting elements. In this embodiment, although the lighting system includes 80 individual lighting elements, because the controller is capable of independently or jointly controlling two crowns, up to 160 individual lighting elements may be included in the lighting system. 160 individual lighting elements consume 104 watts (at 0.65 watts each), and thus the lighting system can be powered via 110 watt power for maximum intensity and luminosity. Alternatively, up to 160 individual lighting elements may be selectively controlled by a single crown and controller in the lighting system rather than relying on two different crowns.

More specifically, in further specific embodiments, the crown of the lighting system has two configurations, and the crown may be operated in and switched between either of the two configurations, even in real-time. These two configurations of the crown are for adjusting and controlling which connectors, along with any light strands and lighting elements that may be engaged therewith, receive power and data from the crown.

For example, the crown may include a number of connectors, designated "x" number. The first configuration of the crown allows for data and power to be fed to each of the x number of connectors and to the lighting elements of the light strands engaged with the connectors. The second configuration of the crown allows for data and power to be fed to x/2 number of connectors, i.e., half as many as in the first configuration. As such, the first configuration may be utilized when one crown and maximum effects are desired, and the second configuration may be utilized when two crowns or fewer lighting elements and light strands are desired. Generally, for aesthetic purposes, every other connector is engaged with a light strand and receives power and data when the crown is operated in the second configuration, i.e., half of the connectors are engaged with light strands and receive power and data in this second configuration. Alternatively, instead of disabling every other connector, adjacent connectors may be disabled in the second configuration of the crown, e.g. when there is no need for aesthetic lighting about the whole perimeter of the ornamental tree. Further, light strands may still be engaged with all of the connectors of the crown regardless of the configuration of the crown, although lighting elements of the light strands engaged with connectors that do not receive power or data will be inoperative while the second configuration of the crown is utilized.

In one specific embodiment, the crown may include 16 connectors, with each light strand including 10 lighting elements. In this embodiment, all 16 connectors and light strands receive power and data when the crown is operated in the first configuration, resulting in 160 individual lighting elements being selectively controlled by the controller of the lighting system. When the crown of this embodiment is operated in the second configuration, only half of the connectors, e.g. every other connector, receives power and data, resulting in 80 individual lighting elements being selectively controlled via the controller. As understood in the art, the number of connectors, light strands, and lighting elements in each light strand may vary in the lighting system, and the specific embodiment above is but one exemplary embodiment.

In embodiments where the crown has two configurations and may be operated and switched between either of the two configurations, the crown may be flexible or rigid. The connectors may be recessed in the crown so that the unused connectors are not readily visible when the crown is operated in the second configuration when light strands are not engaged with the connectors that do not receive power and data. The lighting system generally includes an internal jumper having first and second positions for switching between the first and second configurations of the crown. For example, the first position may correspond with the first configuration of the crown and the second position may correspond with the second configuration of the crown, or vice versa. The lighting system may include a switch for switching the internal jumper between the first and second positions. The switch may be located on, for example, the crown or the controller.

The ability to operate the lighting system with the crown in either the first or second configuration provides greater flexibility and ease-of-use to an end user of the lighting system. For example, the first and second configurations allow for the number of lighting elements selectively controlled and operated by a single crown to be expandable. Further, when two different crowns, or when fewer lighting elements in a single crown, are desired, the end user may simply switch the configuration of the crown without adversely impacting data and power flow and the resulting aesthetic effects. In contrast, including additional light strands in conventional lighting systems that may include programmed lighting requires further programming adjustments to account for the additional lighting elements and requisite data flow.

As introduced above, the controller of the lighting system is configured to individually control each of the lighting elements of the light strands for selectively controlling the lighting elements. The controller generally includes at least one storage device for storing pattern and other data associated with the lighting elements. The storage device may be removable from the controller and is typically selected from, for example, a USB solid state drive (also referred to as flash drives, thumb drives, and the like), a Secure Digital (SD) card, a Compact Flash (CF) card, a micro (SD) card, etc. The lighting system may be sold with the storage device including pattern and other data stored thereon for operating the lighting system and selectively controlling the lighting elements thereof. Alternatively, the storage device may be programmed and/or otherwise provided by an end user of the lighting system, as described below. Typically, the lighting system is shipped to end users with certain pattern data preprogrammed in the controller and/or the storage device.

Pattern data refers to any data for selectively controlling the lighting elements of the lighting system. For example, pattern data may relate to colors, color gradients, flashing, flickering, fading, timing, longevity, pattern cycling, frame rates, and other aspects of the lighting elements of the lighting system. Typically, the storage device includes not only pattern data, but any associated firmware, settings, etc. In certain embodiments, the controller is configured to allow a user, e.g. via the external device, to re-order a playlist (e.g. to shuffle or modify a sequential setting), change a frame rate setting, change a play length setting, implement new firmware, create and store new pattern data, modify a password of the controller, etc.

Separate from the storage device, the controller, which generally includes the digital control device, is typically configured to be programmable by a user for selectively controlling the lighting elements. In certain embodiments, the controller is configured to be in communication with an external device for programming and selectively controlling the lighting elements. The communication between the controller and the external device may be any form of communication, e.g. wireless or wired communication, and the external device is not limited. For example, the external device may be a smart phone, a tablet, a computer, etc. Examples of wired communication include those involving various cables, whether a USB cable, an HDMI cable, etc. Examples of wireless communication includes those based on a variety of protocols, including Wi-Fi, Bluetooth, Wireless Local Area Network (WLAN), Infrared Data Association (IrDA), Zigbee, Radio Frequency Identification (RFID), and Near Field Communication (NFC).

Notably, communication between the controller and the external device is not merely for selecting and stopping and/or starting the pattern data that may be preprogrammed in the controller. Instead, while communication between the controller and the external device may indeed by utilized by a user for selecting and initiating pattern data, communication may also be utilized to modify existing pattern data and/or create new pattern data. For example, the user may program the lighting system via the external device, or the user may download or obtain additional pattern data via the external device, e.g. as an application on or through the external device. In particular, depending on the external device utilized, the user may be able to purchase or obtain additional pattern data, e.g. through an application store for a particular operating system (OS) of the external device.

Thus, the lighting system is not limited to pattern data that is preprogrammed. Instead, the user may modify pattern data in real time, to change the order in which patterns are looped or cycled, the intensity of the lighting elements, the timing of the lighting elements (e.g. cycle speed of any given pattern), etc. The controller may include additional devices, e.g. at least one timer, associated with the programming of pattern data. The controller may also include an audio output jack, as pattern data may have associated audio and the pattern data may be timed along with the associated audio.

In various embodiments, the controller includes at least one button. Electronic buttons are typically included in the controller for quickly controlling pattern data in real time without use of the external device. For example, the at least one button may be utilized to pair the controller with the external device, to restore a particular pattern, to deactivate a particular pattern, to manually select or modify a particular pattern, etc.

As noted above, the controller generally includes a digital control device, and in these embodiments, the controller is configured to transmit data through the crown to the lighting elements of the light strands via digital data transmission. The digital data transmission may utilize any suitable standard or format, e.g. digital multiplex (DMX), streaming-ACN (or E1.31), etc. The digital data transmission utilized by the lighting system is typically asynchronous. Depending on a configuration of the light strands, the light strands may pass pattern data to the crown to be relayed to other light strands, e.g. when the second ends of the light strands terminate via a pass-through terminator.

The present invention additionally provides a decorative article including the lighting system, as shown in FIG. 3. The decorative article may be any decorative article for which the lighting system may provide a desirable aesthetic effect. Generally, the lighting system is utilized for holiday lighting, e.g. Christmas lighting. In these embodiments, the decorative article comprises an ornamental tree.

As introduced above, the lighting system is particularly suited for vertical hanging or attachment to the ornamental tree. In particular, the crown may be disposed about and optionally affixed to the top of the ornamental tree while the light strands are free to individually hang from the crown extending from the crown toward the ground. This prevents tangling or interweaving of the light strands, and allows for simple installation and removal of the lighting system from the ornamental tree. The ornamental tree may be real or artificial, and, if real, may be of any species, although conifers are most utilized.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

What is claimed is:

1. A lighting system comprising:

a light controller;

a crown forming a closed loop and including a plurality of first electrical connectors spaced at a common distance from one another, said crown operatively connected to the light controller; and a plurality of light strands each having first and second ends, a second electrical connector at the first end, and a plurality of individually controllable lights spaced at a common distance from one another between the first and second ends, each of the second electrical connectors releasably connected to one of the first electrical connectors on the crown, each of said light strands hanging vertically from said crown, said light controller in communication with each of said individually controllable lights, said controller adapted to selectively and individually control each of said individually controllable lights, whereby the lights can be individually controlled by the controller when (a) the second electrical connectors on the light strands are operatively connected to the first connectors on the crown and (b) the crown is operatively connected to the light controller.

2. A lighting system comprising:

an electrical cord including a plurality of connectors, said connectors on said electrical cord spaced at a common distance from one another;

a plurality of light strands each having first and second ends, each of said first ends of said light strands removably connected to one of said connectors of said electrical cord, each of said light strands hanging vertically from said electrical cord; each of said light strands including a plurality of individually controllable lighting elements spaced from one another; and a controller in electrical communication with each of said individually controllable lighting elements through said electrical cord and said light strands, said controller configured to selectively and individually control each of said lighting elements.

3. The lighting system of claim 2 wherein the individually controllable lights on each of said light strands are spaced at a common distance from one another.

4. A lighting system comprising:

an electrical cord including a plurality of connectors;

a plurality of light strands each having first and second ends, each of said first ends of said light strands removably connected to one of said connectors of said electrical cord, each of said light strands hanging vertically from said electrical cord; each of said light strands including a plurality of individually controllable lighting elements spaced from one another, said individually controllable lights on each of said light strands spaced at a common distance from one another; and a controller in electrical communication with each of said individually controllable lighting elements through said electrical cord and said light strands, said controller configured to selectively and individually control each of said lighting elements.

* * * * *